US008593446B2

(12) United States Patent
Forster et al.

(10) Patent No.: US 8,593,446 B2
(45) Date of Patent: Nov. 26, 2013

(54) METHOD AND ARRANGEMENT FOR ADJUSTING A COLOR LOCATION, AND ILLUMINATION SYSTEM

(75) Inventors: Georg Forster, Munich (DE); Oskar Schallmoser, Ottobrunn (DE); Ralph Bertram, Nittendorf (DE); Nico Morgenbrod, Martinroda (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 662 days.

(21) Appl. No.: 12/746,537

(22) PCT Filed: Dec. 5, 2008

(86) PCT No.: PCT/EP2008/010344

§ 371 (c)(1),
(2), (4) Date: Jun. 7, 2010

(87) PCT Pub. No.: WO2009/071315

PCT Pub. Date: Jun. 11, 2009

(65) Prior Publication Data

US 2010/0259175 A1 Oct. 14, 2010

(30) Foreign Application Priority Data

Dec. 7, 2007 (DE) ..... 10 2007 059 131

(51) Int. Cl.
*G09G 5/00* (2006.01)

(52) U.S. Cl.
USPC ..... 345/212; 345/214; 345/211; 345/102; 345/82

(58) Field of Classification Search
USPC ..... 315/185 S, 291, 224, 307–311, 315/312–326; 345/102, 78, 82, 204, 345/211–214
See application file for complete search history.

(56) References Cited

U.S. PATENT DOCUMENTS

| | | | | |
|---|---|---|---|---|
| 5,384,519 | A | 1/1995 | Gotoh | |
| 7,009,343 | B2 | 3/2006 | Lim et al. | |
| 2007/0216704 | A1 * | 9/2007 | Roberts et al. | 345/597 |
| 2009/0046453 | A1 | 2/2009 | Kramer | |

FOREIGN PATENT DOCUMENTS

| | | | |
|---|---|---|---|
| DE | 4341669 | A1 | 6/1994 |
| DE | 102005001685 | A1 | 9/2005 |
| DE | 102005022832 | A1 | 11/2006 |
| DE | 202006019332 | U1 | 3/2007 |
| DE | 102006030890 | A1 | 5/2007 |
| EP | 1462711 | A1 | 9/2004 |
| TW | 200617317 | A | 6/2006 |
| WO | 2006011108 | A1 | 2/2006 |
| WO | 2006105649 | A1 | 10/2006 |
| WO | 2006109237 | A1 | 10/2006 |
| WO | 2007071397 | A1 | 6/2007 |

OTHER PUBLICATIONS

International Search Report of PCT/EP2008/010344 mailed on Apr. 2, 2009.
Search Report of DE 10 2007 059 131.6 mailed on Nov. 27, 2008.

(Continued)

*Primary Examiner* — Tuyet Thi Vo

(57) ABSTRACT

A method for setting a color location is provided. The method may include providing n luminous sources of which n-3 luminous sources have been, or are preset; determining a color location difference of the n luminous sources from a desired color location; and setting the 3 luminous sources not preset are set such that the desired color location is achieved.

20 Claims, 3 Drawing Sheets

(56) References Cited

OTHER PUBLICATIONS

English language abstract for DE 10 2006 030 890.
English language abstract for DE 20 2006 019 332 U1.
English translation of International Preliminary Report on Patentability dated Jul. 6, 2010.
Ingo Speier and Marc Salsbury: TIR Systems Ltd. "Color Temperature Tunable White Light LED System" Ingo Speier & Marc Salisbury, Sixth International Conference on Solid State Lighting, Proceedings of the SPIE, vol. 6337, 2006, Abstract.
Muthu, S., and Gaines, J., "Red, green and blue LED-based white light source: implentation challenges and control design", Industry Applications Conference, 2003.

* cited by examiner

METHOD AND ARRANGEMENT FOR ADJUSTING A COLOR LOCATION, AND ILLUMINATION SYSTEM

RELATED APPLICATIONS

The present application is a national stage entry according to 35 U.S.C. §371 of PCT application No.: PCT/EP2008/010344 filed on Dec. 5, 2008, which claims priority from German application No.: 10 2007 059 131.6 filed on Dec. 7, 2007.

TECHNICAL FIELD

Various embodiments relate to a method and an arrangement for setting a color location, and to a luminous system.

BACKGROUND

Three colors are required in order to set and stabilize a color location. Each of these individual colors is described by three color valencies XYZ. The mixing of three colors is uniquely determined by a system of equations including three equations and three unknowns.

With regard to their luminous characteristic, luminous systems based on three individual colors are not satisfactory for applications in lighting engineering; in particular, a viewer of such a luminous characteristic feels it to be unpleasant.

Consequently, more than three individual colors can be used in luminous systems. An overdetermined system of equations results when more than three individual colors are mixed for a color location.

Different luminous means, in particular light-emitting diodes and/or combinations of light-emitting diodes of various wavelengths are used as luminous sources in a luminous system.

SUMMARY

Various embodiments avoid the abovenamed disadvantages and, for example, specify a possibility for setting with particular efficiency a color location of a luminous system including more than three luminous sources.

In accordance with various embodiments, a method is specified for setting a color location,

- in which n luminous sources are provided of which n-3 luminous sources have been, or are preset;
- in which a color location difference of the n luminous sources from a desired color location is determined; and
- in which the 3 luminous sources not preset are set such that the desired color location is achieved.

The color location is, in particular, determined in the form of coordinates of a color space. The intensities of the 3 luminous sources can be modified in such a way that a coordinate in the color space, also denoted as desired color value, is set or achieved.

It may be remarked here that each luminous source can include a plurality of luminous means, for example LEDs. Each luminous source can advantageously include a plurality of LEDs each having substantially the same wavelength. It is also possible for a luminous source to have a plurality of LEDs of different wavelengths.

The presetting of the n-3 luminous sources can advantageously be undertaken offline by taking account of optical and physical parameters (wavelengths of the luminous sources, emission characteristics, physical design as well as of the luminous system (extent, spacings of the luminous sources from one another, etc) including the luminous sources. It is hereby possible to reduce the overdetermined system of equations (3 luminous sources suffice to set the color location) in such a way that a desired color location can be set efficiently by means of the remaining 3 luminous sources.

One development is that the color location difference of the n luminous sources is determined with the aid of at least one sensor, the at least one sensor being, in particular, one of the following sensors:

- a brightness sensor, in particular a $V_\lambda$-evaluated brightness sensor;
- a temperature sensor; and
- a color sensor.

Another development is that at least one sensor each is provided for each luminous source or for each group of luminous sources.

In particular, it is possible to provide for the luminous system comprising the luminous sources a sensor that determines a total intensity of a color location, as well as a temperature.

In particular, one development is that the setting of the color location is performed with the aid of the n luminous sources in such a way that at least one of the target variables of

- color rendering index;
- color quality scale;
- a spectral distribution dependent on application achieves a prescribed value as well as possible.

Accordingly, it is possible to optimize target values with regard to at least one of said target variables, doing so expediently by carrying out this optimization in advance, and storing it in, or saving it in a or for a control and/or regulating unit for setting the luminous sources.

Another development is that an optimization is carried out in advance with regard to the at least one target variable and, in particular, is provided as an item of control information for the 3 luminous sources which are not preset.

A further development is that the setting of the at least one target variable is performed with the aid of the n luminous sources by means of at least one of the following parameters:

- light flux;
- illuminance;
- light intensity;
- luminance.

Within the scope of an additional development, the 3 luminous sources not preset define a triangle in a CIE x-y diagram, the triangle particularly having as large an area as possible.

A next development consists in that the n luminous sources cover a wide spectrum of light.

One refinement is that the n luminous sources or a portion of the n luminous sources have only slight to no overlaps in their respective spectra.

It is thereby advantageously possible for a portion of the luminous sources respectively to supply a dedicated contribution to the total spectrum that is otherwise not supplied by at least a portion of the remaining luminous sources.

One alternative embodiment consists in that the luminous source includes at least one light-emitting diode.

In a next refinement, the 3 luminous sources not preset are set iteratively such that the desired color location is achieved.

It is thereby possible to use the method as regulation that is repeated at specific instants.

Another refinement is that a relative or an absolute desired color location and/or an item of brightness information are/is additionally prescribed in such a way that it/they can be set for the purpose of setting the desired color location.

For example, a user can advantageously set a total brightness and a color (for example within the bounds of a prescribed region), for example in the case of a lamp or luminaire comprising the luminous sources. The luminous sources are set to the desired color location resulting therefrom.

The abovenamed object is also achieved by an arrangement for setting a color location including a processor unit or a computer that is set up in such a way that it is possible thereby to carry out the method described herein.

Furthermore, the abovenamed object is achieved by an arrangement for setting a color location, including

- more than three luminous sources, a first group including three luminous sources, and a second group comprising the remaining luminous sources;
- at least one sensor for determining a color location difference of the luminous sources from a desired color location; and
- a unit for determining a setting of the luminous sources of the first group in order to achieve the desired color location.

It is possible here, in particular, for the arrangement to be designed as, or to include a control and regulating unit (or a color management system).

One development consists in that a unit for determining the color location difference with the aid of the at least one sensor is provided. This can be designed together with the unit for determining a setting of the luminous sources of the first group.

One additional refinement is that a control unit is provided for setting the luminous sources.

Another refinement is that the at least one sensor includes one of the following sensors:

- a brightness sensor, in particular a $V_\lambda$-evaluated brightness sensor;
- a temperature sensor; and
- a color sensor.

Again, in order to achieve the object a luminous system is specified that includes an arrangement as described herein.

Furthermore, the luminous system can be designed as a luminous module, a lamp, luminaire or as a spotlight.

BRIEF DESCRIPTION OF THE DRAWINGS

In the drawings, like reference characters generally refer to the same arts throughout the different views. The drawings are not necessarily to scale emphasis instead generally being placed upon illustrating the principles of the invention. In the following description, various embodiments of the invention are described with reference to the following drawings, in which.

DETAILED DESCRIPTION

Figure 1:
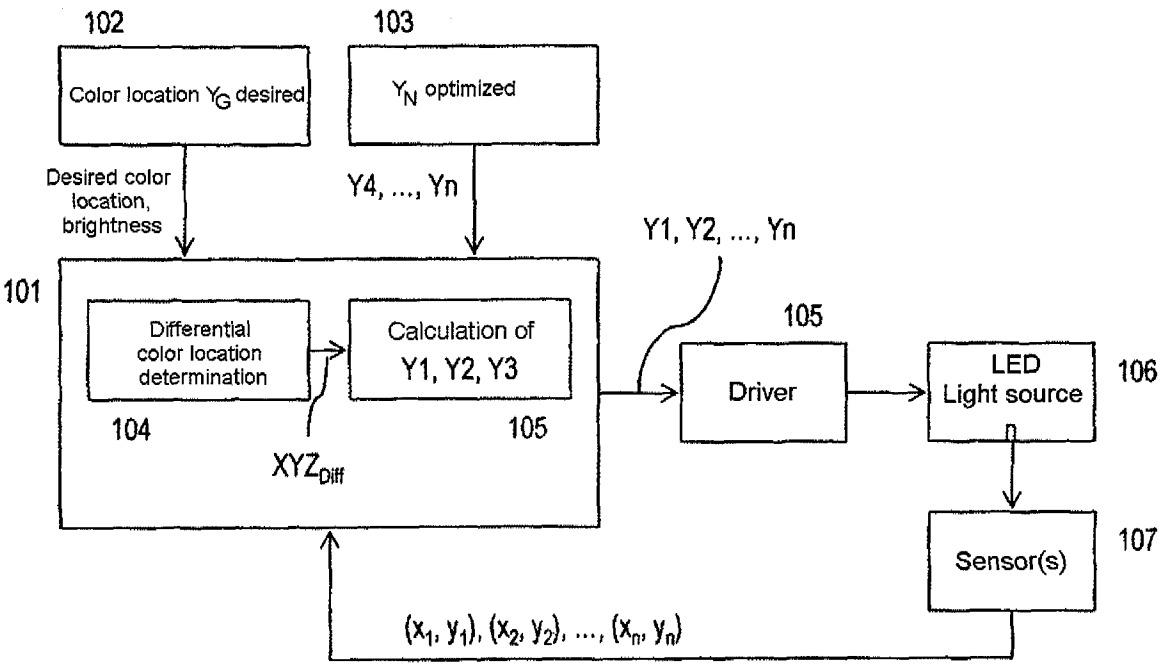
FIG. 1 shows a possibility of controlling and/or setting a desired color location by means of a color management system.

The following detailed description refers to the accompanying drawings that show, by way of illustration, specific details and embodiments in which the invention may be practiced.

The approach presented here enables, in particular, a color location to be set and to be controlled continuously and/or iteratively by means of a color management system, preferably more than three light-emitting diodes of different wavelengths being used.

It is assumed, by way of example, that a luminous system has n luminous sources that are preferably designed as LEDs.

The first step is to determine the n luminous sources with the aid of at least one of the following parameters:

light flux;

illuminance;

light intensity;

luminance.

In this case, a ratio of the abovenamed parameters for the n light sources can be set in such a way that at least one of the following prescribable target variables of color rendering index (CRI);

color quality scale (CQS);

a spectral distribution dependent on application is achieved as well as possible.

A suitable optimization can be used for this purpose.

For example, it is possible to select or prescribe the n luminous sources such that these have an appropriately favorable and, in the case of a luminous system for a viewer, a spectral distribution felt to be pleasant. This can be achieved by using luminous sources that respectively constitute a contribution in the luminous spectrum of the luminous system which supplements one luminous source in comparison with the others. For example, if one light source, for example an LED, has a very restricted spectral extent inside the desired spectrum of the luminous system, it is then possible to provide further LEDs, whose spectra lie supplementarily in another frequency range. The total spectrum therefore results from the superposition of the spectra of the individual luminous sources.

In particular, it is possible to provide an (essentially) white luminous source with an appropriately wide spectrum.

It is therefore possible to achieve when setting the color location of the luminous system the situation that, because of the appropriately optimized spectrum, the luminous system renders the color set or preselected in a way that is pleasant and uniform for the viewer.

It is preferred to prescribe n-3 specific parameters as color valencies Y4 . . . Yn.

A color location deviation, for example a color location difference, from the desired color location to be set can be determined on the basis of the prescribed n-3 luminous sources, which respectively have specific color valencies. It is possible, in particular, for this purpose to set a desired color location and a brightness of the luminous system, for example for a user to do so.

A desired color valence Y-total, is preferably set to 100% or to the value to be achieved by the system (brightness stipulation by the user) in order to determine the color location difference.

The 3 luminous sources with their prescribed colors are now available to achieve a setting to the desired color location. For this purpose, these 3 luminous sources are, in particular, to be prescribed such that they define in a CIE x-y diagram an area that is as large as possible (for example a triangle as large as possible).

The parameters for setting the 3 luminous sources can be determined as follows:

$$\begin{pmatrix} X_{Diff} \\ Y_{Diff} \\ Z_{Diff} \end{pmatrix} = \begin{pmatrix} \frac{x_1}{y_1} & \frac{x_2}{y_2} & \frac{x_3}{y_3} \\ 1 & 1 & 1 \\ \frac{z_1}{y_1} & \frac{z_2}{y_2} & \frac{z_3}{y_3} \end{pmatrix} \cdot \begin{pmatrix} Y_1 \\ Y_2 \\ Y_3 \end{pmatrix}$$

This equation enables a colorimetric calculation of the photometric variables or parameters $Y_1$, $Y_2$ and $Y_3$ to be set so as to set the differential color location or to achieve the desired color location.

It may be remarked here that each of the 3 luminous sources can also include more than one luminous means and/or more than one LED. For example, it is possible here for a plurality of LEDs of substantially the same color valence to be combined to form one luminous source. Consequently, it is also possible to combine a plurality of LEDs of variable color valences to form a luminous source in accordance with the present description.

A measurement of the at least one actuating and/or controlled variable of the luminous system is performed by means of at least one sensor including, in particular:

at least one brightness sensor, in particular at least one $V_\lambda$-evaluated brightness sensor;

at least one temperature sensor; and at least one color sensor.

Color valencies of the individual colors on the luminous sources, and a requisite shift (x, y) for achieving the desired color location can be determined on the basis of the measured at least one actuating and/or controlled variable of the luminous system.

Furthermore, regulation can be performed iteratively, continuously and/or at specific instants in such a way that a control unit (color management system) once again determines the color valencies Y to be set (with the aid of renewed measurement of the at least one actuating and/or controlled variable of the luminous system), and thereby, for example, reacts to incident changes in the depletion layer temperatures of the LEDs by adjustment to or stabilization of the desired color location.

Should a luminous source include a white light source that can be regulated, it can occur that the individual colors are not required separately in dependence on the desired color location in order to achieve the desired color location. A common use of a control channel is therefore possible.

Given use of more than 3 luminous sources (each luminous source can in this case comprise at least one light-emitting diode, in particular), the 3 luminous sources advantageously having different colors and defining as large a color space as possible, the approach described here allows the possibility of regulating three colors in order to stabilize a freely prescribed color location inside the color space, and of determining a spectrum optimized in relation to one or more target variables.

In addition, an optimization of the spectrum can be determined with regard to specific target variables, in particular once in advance. Such an optimization can, for example, be complicated and time consuming and can advantageously therefore not be performed on the luminous module itself. The optimization serves as input for the regulation (color management system) for the purpose of achieving or setting the desired color location with the aid of the freely settable luminous sources. The solution of the system of equations for setting the desired color location by means of three luminous sources can be carried out quickly and efficiently on the luminous module.

Figure 2:
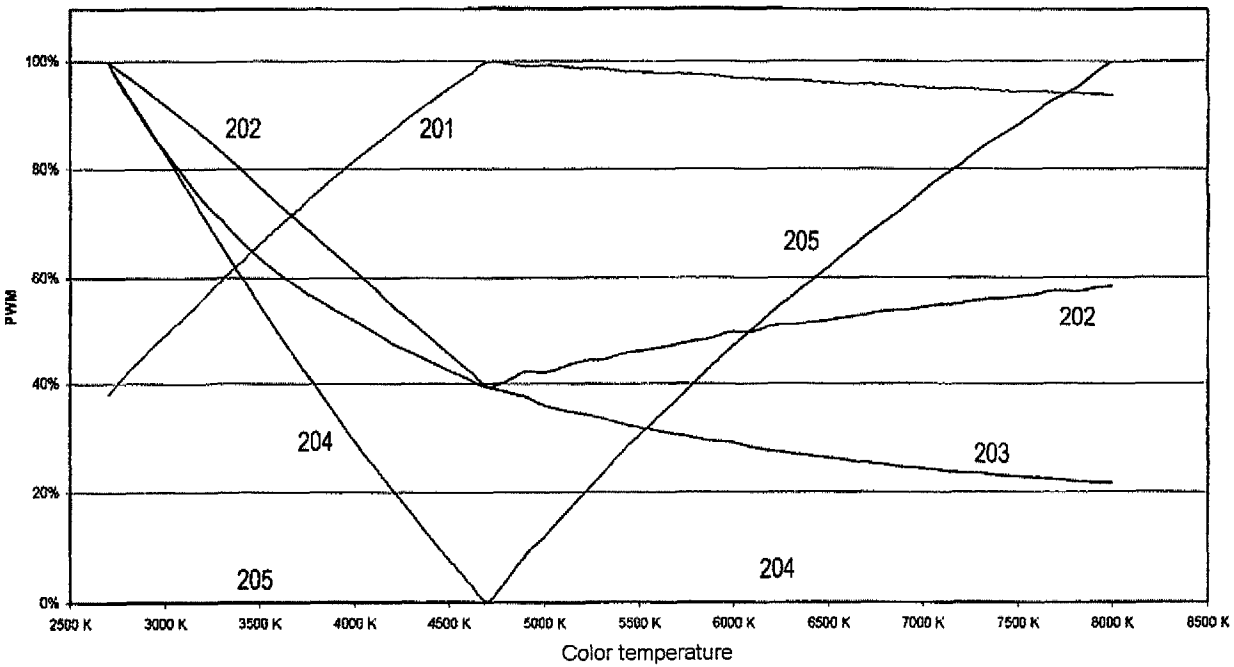
FIG. 2 shows control curves for achieving an optimized color rendition of the luminous system including a plurality (5) of luminous sources.

FIG. 1 shows a possibility for regulating and/or setting a desired color location by means of a color management system 101. Here, a total intensity of a desired color location comprising a desired color location with associated brightness serves as input variable 102. An optimized intensity of the colors of the n luminous sources in accordance with a control curve as shown in FIG. 2 constitutes a further input variable 103 for the color management system 101. By way of example, starting from n luminous sources the intensities of the luminous sources 4 to n are determined by the color management system 101 with the aid of the control curves in accordance with FIG. 2, and with the aid of an optimization, determined in advance, in accordance with at least one target variable. This stipulation is used to set the remaining luminous sources 1 to 3, in order to achieve the desired color location.

The color management system 101 includes a unit 104 for determining differential color location, and a unit 105 for calculating the intensities of the individual colors Y1, Y2 and Y3. The color management system 101 therefore provides as output signal the intensities Y1 to Yn of the luminous sources 1 to n, which are used by a driver 108 to set the luminous sources, here the LED light sources 106.

At least one sensor 107 is used in order to determine the desired color location of the luminous system including the LED light sources 106. The current color location for each LED or luminous source and/or the total color location with associated temperature is passed onto the color management system 101 where a difference from the desired color location is determined and the intensities of the luminous sources Y1, Y2 and Y3 are determined correspondingly and passed on, together with the intensities, stored for the temperature, for the luminous sources Y4 to Yn, to the driver 108 for setting the LED light sources.

Control curves for achieving a color rendition of the luminous system that is optimized (and advantageously determined in advance) are illustrated in FIG. 2.

Specified in kelvin along the abscissa is the color temperature, and in per cent along the ordinate is the brightness of the respective luminous source, to be set by pulse width modulation PWM.

Control curves for 5 light-emitting diodes are shown by way of example in FIG. 2. A control curve 201 shows the profile for a white LED, a control curve 202 shows the profile for a green LED, a control curve 203 shows the profile for a red LED, a control curve 204 shows the profile for a yellow LED, the control curve 204 having a brightness of approximately 0% starting from approximately 4700 K, and a control curve 205 shows the profile for a blue LED, the control curve 205 having a brightness of approximately 0% up to approximately 4700 K.

Starting from 4700 K, it is possible to switch channels from the yellow LED to the blue LED.

The profile of the control curves 201 to 205 can be determined, for example, by means of a simulation of the luminous system.

Figure 3:
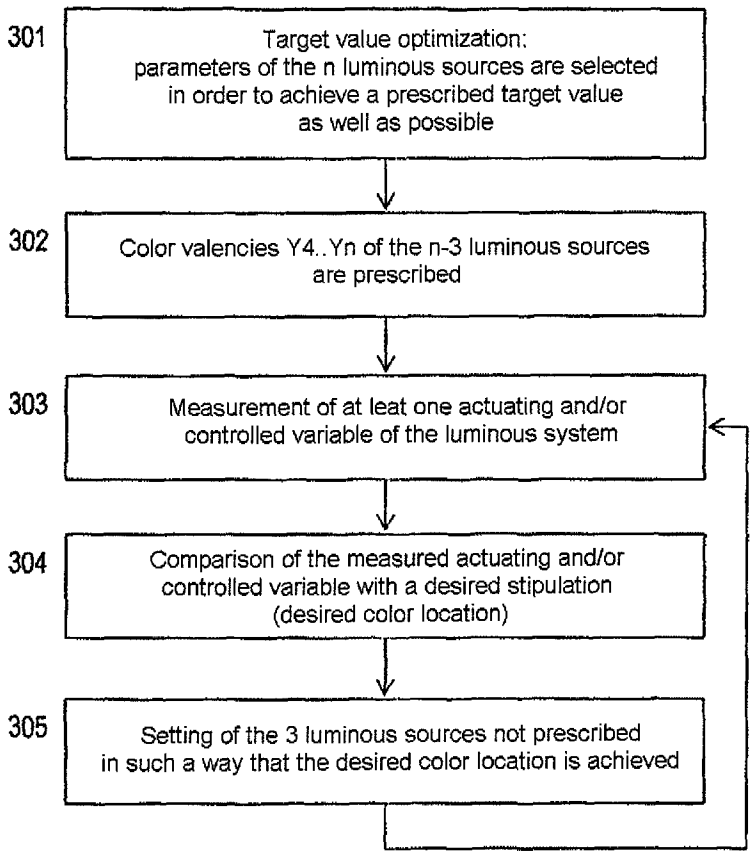
FIG. 3 shows a flowchart for a method for setting a color location.

FIG. 3 shows a flowchart for a method for setting a color location.

In a step 301, a target value is optimized, advantageously in dependence on the respective luminous system, in such a way that the parameter of the n luminous sources is selected or determined such that a prescribed target value is achieved as well as possible. For example, at least one of the following variables can serve as parameter: light flux; illuminance; light intensity; and/or luminance. By way of example, at least one of the following target variables can be used to optimize the target value: color rendering index; color quality scale; and/or a spectral distribution dependent on application.

Color valencies Y4 to Yn of the n-3 luminous sources are prescribed in a step 302 with the aid of the target value optimization.

At least one actuating and/or controlled variable of the luminous system are/is measured in a step 303. In particular, at least one such actuating and/or controlled variable can be determined for each luminous source.

In a step 304, a comparison is made between the measured actuating and/or controlled variable and a desired stipulation, in particular a desired color value. The determined deviation is thereby overcome and the desired color value is set by setting the 3 luminous sources not prescribed (step 305). It is optionally possible after step 305 to branch to step 303, thus achieving an iterative regulation and/or setting of the desired color location.

The approach presented here can, in particular, be carried out in a luminous system, for example a luminous unit or luminous module comprising a processor unit and/or a computer or a regulating unit for determining and setting the desired color location. The luminous system can in this case comprise a plurality of luminous sources each of which has, in particular, at least one LED.

The luminous system or luminous module described can, in particular, be used in a spotlight and/or in a lamp and/or luminaire. The brightness and/or the color can preferably be prescribed within certain limits by the user. Thus, for example, a color ranging from bluish as far as reddish light can be enabled, the lamp employing the approach presented here to maintain the respectively selected color and the associated brightness.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A method for setting a color location, the method comprising:

providing n luminous sources of which n-3 luminous sources have been, or are preset;

determining a color location difference of the n luminous sources from a desired color location; and setting the 3 luminous sources not preset such that the desired color location is achieved;

wherein the n luminous sources comprise more than three luminous sources.

2. The method as claimed in claim 1, wherein the 3 luminous sources not preset define a triangle in a CIE x-y diagram.

3. The method as claimed in claim 1, wherein the n luminous sources cover a wide spectrum of light.

4. The method as claimed in claim 1, wherein the n luminous sources or a portion of the n luminous sources have only slight to no overlaps in their respective spectra.

5. The method as claimed in claim 1, wherein the luminous source comprises at least one light-emitting diode.

6. The method as claimed in claim 1, wherein the 3 luminous sources not preset are set iteratively such that the desired color location is achieved.

7. The method as claimed in claim 1, wherein at least one of a relative or absolute desired color location and an item of brightness information is additionally prescribed in such a way that it can be set for the purpose of setting the desired color location.

8. The method as claimed in claim 1, wherein the color location difference of the n luminous sources is determined with the aid of at least one sensor.

9. The method as claimed in claim 8, wherein at least one sensor each is provided for each luminous source or for each group of luminous sources.

10. The method as claimed in claim 8, wherein the color location difference of the n luminous sources is determined with the aid of at least one sensor, the at least one sensor being one of the following sensors: a brightness sensor; a temperature sensor; and a color sensor.

11. The method as claimed in claim 1, wherein the setting of the color location is performed with the aid of the n luminous sources in such a way that at least one of the target variables of color rendering index; color quality scale; a spectral distribution dependent on application achieves a prescribed value as well as possible.

12. The method as claimed in claim 11, wherein an optimization is carried out in advance with regard to the at least one target variable.

13. The method as claimed in claim 11, wherein the setting of the at least one target variable is performed with the aid of the n luminous sources by means of at least one of the following parameters: light flux; illuminance; light intensity; and luminance.

14. An arrangement for setting a color location comprising;

a processor unit of a computer carrying out a method for setting a color location, the method comprising:

providing n luminous sources of which n-3 luminous sources have been, or are preset;

determining a color location difference of the n luminous sources from a desired color location; and setting the 3 luminous sources not preset such that the desired color location is achieved;

wherein the n luminous sources comprise more than three luminous sources.

15. An arrangement for setting a color location, the arrangement comprising more than three luminous sources, a first group comprising three luminous sources, and a second group comprising the remaining luminous sources;

at least one sensor for determining a color location difference of the luminous sources from a desired color location; and unit configured to determine a setting of the luminous sources of the first group in order to achieve the desired color location.

16. The arrangement as claimed in claim 15, further comprising: a unit configured to determine the color location difference with the aid of the at least one sensor.

17. The arrangement as claimed in claim 15, further comprising: a controller configured to set the luminous sources.

18. The arrangement as claimed in claim 15, wherein the at least one sensor comprises at least one of the following sensors: a brightness sensor; a temperature sensor; and a color sensor.

19. A luminous system comprising an arrangement for setting a color location, the arrangement comprising:

a processor unit of a computer carrying out a method for setting a color location, the method comprising:

providing n luminous sources of which n-3 luminous sources have been, or are preset;

determining a color location difference of the n luminous sources from a desired color location; and setting the 3 luminous sources not preset such that the desired color location is achieved;

wherein the n luminous sources comprise more than three luminous sources.

20. The luminous system as claimed in claim 19, wherein the luminous system is selected from a group consisting of a lamp; a luminaire; and a spotlight.

* * * * *